US007448218B2

(12) United States Patent
Heilos et al.

(10) Patent No.: US 7,448,218 B2
(45) Date of Patent: Nov. 11, 2008

(54) PREMIX BURNER AND METHOD FOR BURNING A LOW-CALORIE COMBUSTION GAS

(75) Inventors: Andreas Heilos, Mülheim an der Ruhr (DE); Berthold Köstlin, Duisburg (DE); Bernd Prade, Mülheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 260 days.

(21) Appl. No.: 10/590,379

(22) PCT Filed: Feb. 15, 2005

(86) PCT No.: PCT/EP2005/050656

§ 371 (c)(1),
(2), (4) Date: Aug. 23, 2006

(87) PCT Pub. No.: WO2005/080878

PCT Pub. Date: Sep. 1, 2005

(65) Prior Publication Data

US 2007/0275337 A1 Nov. 29, 2007

(30) Foreign Application Priority Data

Feb. 24, 2004 (EP) ..... 04004137

(51) Int. Cl.
*F02C 3/28* (2006.01)
*F23R 3/36* (2006.01)
*F23D 14/58* (2006.01)

(52) U.S. Cl. ..... 60/776; 60/737; 60/748; 60/39.463; 431/9; 431/183

(58) Field of Classification Search ..... 60/772, 60/776, 737, 748, 39.463; 431/9, 182, 183
See application file for complete search history.

(56) References Cited

U.S. PATENT DOCUMENTS

| | | | | | |
|---|---|---|---|---|---|
| 4,498,288 | A | | 2/1985 | Vogt | |
| 4,761,948 | A | | 8/1988 | Sood et al. | |
| 5,451,160 | A | | 9/1995 | Becker | |
| 5,673,551 | A | * | 10/1997 | Dobbeling | 60/776 |
| 5,680,766 | A | * | 10/1997 | Joshi et al. | 60/746 |
| 5,829,967 | A | | 11/1998 | Chyou | |
| 6,016,658 | A | * | 1/2000 | Willis et al. | 60/737 |

(Continued)

FOREIGN PATENT DOCUMENTS

DE 42 12 810 A1 10/1992

(Continued)

*Primary Examiner*—Ted Kim

(57) ABSTRACT

The invention relates to a pre-mix burner for burning a low-calorie combustion gas, said burner comprising an air duct which extends along an axis of the burner and can be used to supply combustion air. A swirling device is arranged in the air duct and is used to apply a swirling motion to the combustion air. An injection device for the low-calorie combustion gas is provided downstream of the swirling device. The injection device comprises inlets for the combustion gas, such that the formation of wake regions in the air channel is prevented. The invention also relates to a method for burning a low-calorie combustion gas, according to which a swirling motion is applied to the combustion air, low-calorie combustion gas is injected into the swirled combustion air and intensively mixed therewith, and the mixture is then burned.

20 Claims, 3 Drawing Sheets

U.S. PATENT DOCUMENTS

| | | | | |
|---|---|---|---|---|
| 6,360,776 | B1 * | 3/2002 | McCormick et al. | 60/737 |
| 7,003,957 | B2 * | 2/2006 | Griffin et al. | 60/737 |
| 7,013,648 | B2 * | 3/2006 | Griffin et al. | 60/737 |

FOREIGN PATENT DOCUMENTS

| | | | |
|---|---|---|---|
| DE | 44 09 918 | A1 | 9/1995 |
| EP | 0 625 673 | A2 | 11/1994 |
| EP | 0 908 671 | A1 | 4/1999 |
| WO | WO 03/008768 | A1 | 1/2003 |
| WO | WO 03/036167 | A1 | 5/2003 |
| WO | WO 03/098110 | A1 | 11/2003 |

* cited by examiner

PREMIX BURNER AND METHOD FOR BURNING A LOW-CALORIE COMBUSTION GAS

CROSS REFERENCE TO RELATED APPLICATIONS

This application is the US National Stage of International Application No. PCT/EP2005/050656, filed Feb. 15, 2005 and claims the benefit thereof. The International Application claims the benefits of European Patent application No. 04004137.8 filed Feb. 24, 2004. All of the applications are incorporated by reference herein in their entirety.

FIELD OF THE INVENTION

The invention relates to a premix burner for burning a low-calorie combustion gas, in particular a synthesis gas. The invention also relates to a method for burning a low-calorie combustion gas.

BACKGROUND OF THE INVENTION

A burner for gaseous fuels, as used in particular in a gas turbine installation, is known from example from DE 42 12 810 A1. According to this, combustion air is fed through an annular air duct system and fuel is fed through a further annular duct system for combustion. A high-calorie fuel (natural gas or fuel oil) is thereby injected from the fuel duct into the air duct, either directly or from helical blades configured as hollow blades.

The most homogenous mixture possible of fuel and air should therefore be obtained, in order to achieve combustion with low levels of nitrogen oxide. For environmental protection reasons and because of corresponding legal provisions governing pollutant emissions, the lowest possible level of nitrogen oxide production is an important combustion requirement, in particular for combustion in the gas turbine installation of a power plant. The formation of nitrogen oxides increases exponentially with flame temperature during combustion. If the fuel/air mixture is non-homogenous, a certain distribution of flame temperatures results in the combustion area. The maximum temperatures of such a distribution then determine the quantity of nitrogen oxides formed according to the cited relationship between nitrogen oxide formation and flame temperature. Combustion of a homogenous fuel/air mixture thus achieves a lower nitrogen oxide emission for the same mean flame temperature than combustion of a non-homogenous mixture. The burner design in the publication cited above achieves a spatially good air/fuel mixture.

Compared with the conventional gas turbine fuels, natural gas and crude oil, which essentially comprise hydrocarbon compounds, the combustible components of synthesis gas are essentially carbon monoxide and hydrogen. For the optional operation of a gas turbine with synthesis gas from a gasification facility and a secondary or substitute fuel, the burner in the combustion chamber assigned to the gas turbine must be designed as a twin or multi-fuel burner, which can be fed both the synthesis gas and the secondary fuel, e.g. natural gas or fuel oil as required. The respective fuel is hereby fed to the combustion zone via a fuel passage in the burner.

Depending on the gasification method and the overall installation design, the calorific value of the synthesis gas is around five to ten times less than the calorific value of natural gas. The main components in addition to CO and $H_2$ are inert elements such as nitrogen and/or steam and in some instances also carbon dioxide. Its low calorific value means that large flow volumes of combustion gas have to be fed through the burner to the combustion chamber. This means that one or more separate fuel passages have to be provided for the combustion of low-calorie fuels, such as synthesis gas. Such a multi-passage burner, which is also suitable for synthesis gas operation, is disclosed for example in EP 1 227 920 A1.

As well as the stoichiometric combustion temperature of the synthesis gas, the quality of the synthesis gas/air mixture in front of the flame is an important factor influencing the prevention of temperature peaks and thus impacting on the minimization of thermal nitrogen oxide formation.

As far as the increasingly stringent requirements relating to nitrogen oxide emissions are concerned, premix combustion is of increasing significance even for the combustion of low-calorie gases.

SUMMARY OF THE INVENTION

The object of the invention is therefore to specify a premix burner for burning a low-calorie combustion gas. A further object of the invention is to specify a method for burning a low-calorie combustion gas.

The first object is achieved according to the invention by a premix burner for burning a low-calorie combustion gas, with a premix air duct extending along a burner axis, via which combustion air can be supplied, and with a helical device disposed in the premix air duct, with a injection device for the low-calorie combustion gas disposed downstream from the helical device in the flow direction of the combustion air.

The invention is based on the consideration that the fuel/combustion air mixture is of particular importance in respect of ensuring low-pollutant operation. Temperature peaks can only be prevented with the most homogenous mixture possible. As large flow volumes of combustion gas are required with low-calorie combustion gases and have to be mixed with combustion air, the solution to the task of mixing has presented technical experts with particular challenges with regard to the structural design of such burners.

With the inventive synthesis gas premix burner, a burner design is first proposed, which makes the pollutant emission-related advantages of premix operation also applicable when low-calorie synthesis gases are used as the fuel. Undiluted or partially diluted low-calorie combustion gas is fed into the already swirling mass flow through the injection device downstream from the helical device. Largely homogenous mixing of the synthesis gas and the swirling air mass flow therefore results in the spatial area downstream from the helical device. Combustion of the premixed combustion gas/air mixture takes place downstream from the burner at a temperature corresponding to the premixed air ratio. To stabilize the low-calorie premix flame—particularly in the part load range—a small partial mass flow of the low-calorie combustion gas can be separated off beforehand and supplied in the combustion chamber via a back-up flame operated in diffusion mode, e.g. around 5% to 20% of the total flow volume of combustion gas.

This structure with the injection device downstream from the helical device allows sufficiently large flow volumes of low-calorie combustion gas to be mixed with the combustion air, allowing extremely good mixing results to be achieved. This has a particularly advantageous impact on the pollutant levels of the premix burner.

It is also advantageous that the proven premix combustion design for high-calorie fuels, such as natural gas or oil, can be adopted without modification, with the result that lengthy optimization processes and/or structural changes are not required. In other words it is possible to extend a conventional combustion system, which is designed for high-calorie fuels, by means of an additional fuel passage for low-calorie combustion gases using the injection device linked for flow purposes to the air duct, without the structural conversion having a disadvantageous influence on the existing conventional combustion system, e.g. in respect of any pressure losses that might occur.

The premix burner can thus be operated both with the synthesis gas, which is produced for example from coal, industrial residues or waste, and with a secondary fuel, such as natural gas or oil. In the case of synthesis gas premix operation, the low-calorie fuel is injected into the premix air duct solely via the injection device downstream from the helical device, with the swirling combustion air ensuring a particularly homogenous mixture. This design also means that structural measures, which are associated with additional components, are not required, such that the swirling air mass flow in particular is not impeded by any incorporated components.

The premix burner effects combustion according to the air ratio setting at significantly lower temperatures, which ultimately results in minimization of thermal nitrogen oxide formation during combustion of the low-calorie combustion gas.

In a particularly advantageous embodiment the injection device has a number of inlet openings for combustion gas, which open into the premix air duct.

In a preferred embodiment, the inlet openings for the low-calorie combustion gas are formed such that the formation of wake regions in the premix air duct is prevented. When a gas flows in at very high speed, as is the case after an injection device, a wake region with significantly higher turbulence can result behind the inlet openings. The turbulent wake region can result in the formation of backflow and recirculation, which in turn can cause flashback. The non-stationary nature of the wake can also cause the flow to be canceled. To ensure reliable premix operation, the form of the inlet openings should be selected such that these negative effects are prevented.

In a particularly advantageous embodiment, the inlet openings for the combustion gas have a cross-section, the cross-section having a longitudinal extension and a transverse extension, the longitudinal extension being greater than the transverse extension. An almost circular opening is in principle also possible. It has however proven that an elliptic form of the injection openings counteracts the problem of wake regions particularly effectively, thereby ensuring reliable operation of the premix burner.

The longitudinal extension is preferably 3 to 10 times the transverse extension. If the longitudinal extension is less than 3 times the transverse extension, the configuration resembles a circular inlet opening, which could favor the formation of a wake region. On the other hand a longitudinal extension that is more than 10 times the transverse extension is not essential and should be avoided for spatial reasons.

The cross-section of the inlet openings preferably has the form of a slot or a rectangle with rounded corners or a teardrop. These forms, with which one side can be longer than the transverse side, have proven particularly suitable for faultless operation of the premix burner. It is also advantageous, if there are no sharp edges in the cross-section of the inlet opening. In regions where the angle is less than 90°, dead zones frequently occur in the flow. These edges are preferably rounded (beveled).

In a particularly preferred embodiment, the longitudinal axis defined by the longitudinal extension is essentially parallel to the flow direction of the combustion air. The narrower side of the inlet opening is then perpendicular to the swirling air mass flow, thereby significantly reducing the resistance produced by the low-calorie combustion gas in the path of the combustion air. The combustion gas flowing out also presents no significant obstacle to the combustion air but the combustion air and combustion gas simply mix gradually and thoroughly over the longitudinal extension of the inlet opening. As a result there is no vorticity in the boundary layer between the combustion air and the low-calorie combustion gas and wake formation is thereby prevented. Particularly efficient and homogenous mixing of the combustion air and combustion gas is also achieved.

In a preferred embodiment, the flow direction of the combustion air is at an angle to the burner axis, said angle being between 0° and 90°.

The injection device preferably has a gas distribution ring, which encloses the premix air duct in a radially outward manner. The premix air duct is thereby preferably configured as an annular duct, having an outer duct wall, which is punctuated by a number of inlet openings, e.g. holes, which are connected for flow purposes to the gas distribution ring. This ensures the injection of low-calorie combustion gas into the swirling combustion air over the entire periphery of the annular duct. The diameter of the holes, the number of holes and their distribution on the outer duct wall should be designed according to the requirements for the flow volume of low-calorie combustion gas. A corresponding structural design of the injection device allows a sufficiently large flow volume of combustion gas to be injected, thereby ensuring stable synthesis gas premix operation.

In a preferred embodiment, the outer duct wall tapers in a cone shape in the flow direction of the combustion air. The fact that the low-calorie combustion gas is injected through the inlet openings in the outer cone means that there is no need for any additional components for the injection device, which might have a negative impact on the air flow, such that operation is also possible with conventional fuels (natural gas or fuel oil) as required without restriction.

In a particularly preferred embodiment the premix burner is used in a combustion chamber, for example an annular combustion chamber. Such a combustion chamber is advantageously configured as a combustion chamber of a gas turbine, for example as an annular combustion chamber of a stationary gas turbine.

The method-related object is achieved according to the invention by a method for burning a low-calorie combustion gas, with which combustion air is swirled, low-calorie combustion gas is injected into the swirling combustion air and mixed with it and the mixture is burned.

This method allows a particularly homogenous combustion mixture to be achieved, it being possible to mix large flow volumes of low-calorie combustion gas with the combustion air.

Undiluted or partially diluted low-calorie combustion gas is hereby advantageously injected into the swirling combustion air.

With this method the low-calorie combustion gas is preferably injected such that the formation of wake regions in the premix air duct is prevented.

The method counteracts the formation of wake regions in the premix air duct in a particularly effective manner, if the low-calorie combustion gas is preferably injected through inlet openings and these inlet openings have a cross-section, the cross-section having a longitudinal extension and a transverse extension, the longitudinal extension being greater than the transverse extension.

With this method the longitudinal axis defined by the longitudinal extension is preferably essentially parallel to the flow direction of the combustion air, such that low-calorie combustion gas is injected parallel to the flow direction of the combustion air.

It is particularly advantageous if the low-calorie combustion gas used is a gasified fossil fuel, in particular gasified coal. The method is preferably implemented during operation of a gas turbine burner, with a synthesis gas, which represents a low-calorie fuel, being burned during premix operation.

BRIEF DESCRIPTION OF THE DRAWINGS

Some exemplary embodiments of the invention are described in more detail in the drawing, in which.

DETAILED DESCRIPTION OF THE INVENTION

Figure 1:
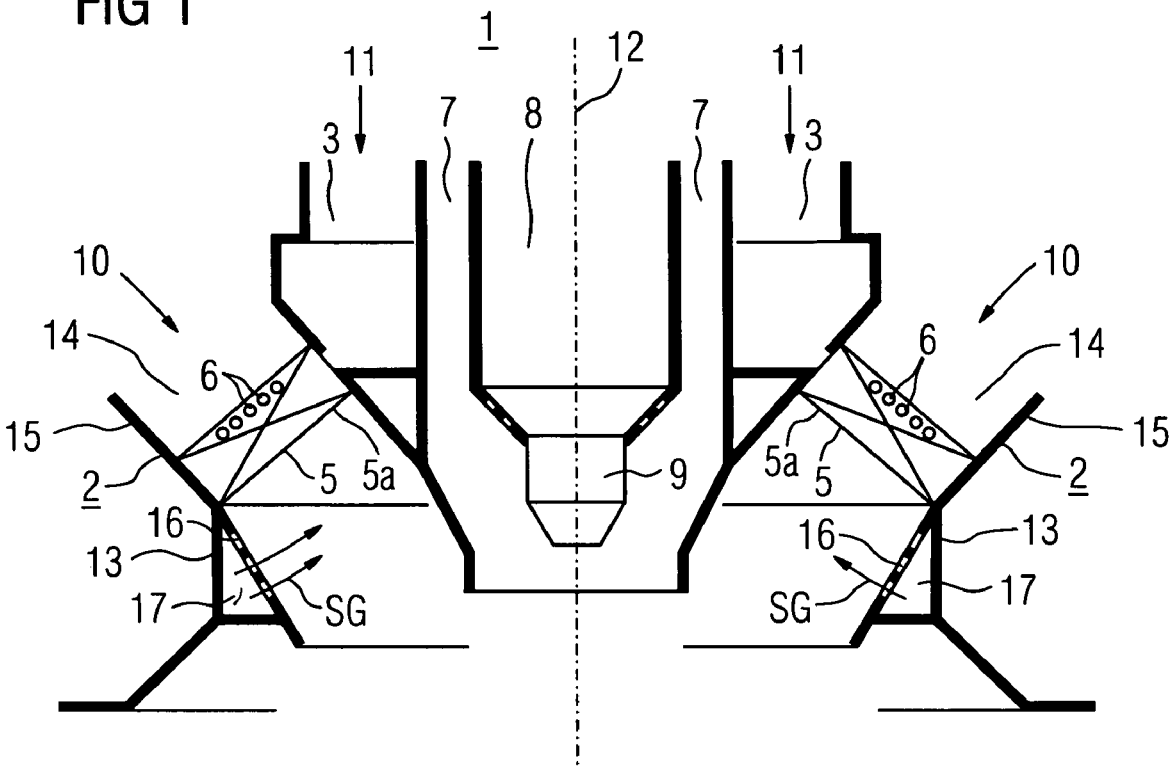
FIG. 1 shows a longitudinal section through a premix burner as claimed in the invention

FIG. 1 shows a premix burner 1, with approximate rotational symmetry in respect of a burner axis 12. A pilot burner 9 oriented along the burner axis 12 with a fuel supply duct 8 and an annular air supply duct 7 enclosing this in a concentric manner is enclosed concentrically by an annular fuel duct 3. This annular fuel duct 3 is partially enclosed in a concentric manner by a premix air duct 2. The premix air duct 2 is configured as an annular duct 14, having an outer duct wall 15. Incorporated in this premix air duct 2—shown schematically—is an overlapping ring of helical blades 5, forming a helical device. At least one of these helical blades 5 is configured as a hollow blade 5*a*. It has an inlet 6, formed by a number of small openings, for the supply of fuel. The hollow blade 5*a* is thereby designed for the supply of high-calorie fuel 11, e.g. natural gas or fuel oil. The annular fuel duct 3 opens into this hollow blade 5*a*.

The premix burner 1 can be operated via the pilot burner 9 as a diffusion burner. However it is generally used as a premix burner, i.e. fuel and air are first mixed and then supplied for combustion. The pilot burner 9 thereby serves to maintain a pilot flame, which stabilizes combustion during premix burner operation if the fuel/air ratio varies.

During the combustion of high-calorie fuel 11, i.e. natural gas or fuel oil for example, combustion air 10 and the high-calorie fuel 11 are mixed in the premix air duct 2 and then supplied for combustion. In the exemplary embodiment shown the high-calorie fuel 11 is thereby routed from the annular fuel duct 3 into a hollow blade 5*a* of the overlapping ring of helical blades 5 and introduced from there via the inlet 6 into the combustion air 10 in the premix air duct 2.

With the inventive premix burner 1, combustion of a low-calorie combustion gas SG, for example a synthesis gas from a coal gasification process, is also optionally possible. To this end an injection device 13 for the low-calorie combustion gas SG is provided downstream from the helical device 5 in the flow direction of the combustion air 10. The injection device 13 comprises a number of inlet openings 16 for the combustion gas SG. The inlet openings 16 open into the premix air duct 2. The injection device 13 has a gas distribution ring 17, which encloses the premix air duct 2 in a radially outward manner. This means that low-calorie combustion gas SG can be injected into the premix air duct 2 configured as an annular duct 14 around the entire periphery downstream from the helical device 5 into the distributed combustion air flow 10. The outer duct wall 15 of the annular duct 14 is hereby punctuated with a number of inlet openings 16, e.g. holes, which are connected for flow purposes to the gas distribution ring 17. In this manner the gas distribution ring 17 also ensures a distributor function, such that low-calorie combustion gas SG can be supplied at the required pressure and flow volume and can be mixed in with the swirling combustion air 10 through the number of inlet openings 16 in the outer duct wall 15. This advantageously achieves a homogenous and regular mixing of combustion air 10 and low-calorie combustion gas SG. Corresponding structural design and dimensioning for flow purposes ensure that a sufficiently large flow volume of combustion gas SG can be supplied by means of the injection device 13 or the gas distribution ring 17 for synthesis gas premix operation. In an alternative embodiment or as an optional addition to the gas distribution ring 17, which is disposed in a radially outward manner—not shown in more detail here in FIG. 1—the gas distribution ring 17 can also bound the premix air duct 2 in a radially inward manner, such that synthesis gas SG can be injected. The outer duct wall 15 tapers in the flow direction of the combustion air 10. The premix burner 1 for burning a low-calorie combustion gas SG can be used in a combustion chamber of a gas turbine, for example an annular combustion chamber of a stationary gas turbine.

With the inventive premix burner 1 optional operation with a synthesis gas from a gasification facility or with a secondary or substitute fuel is possible, as the premix burner 1 is designed as a twin or multi-fuel burner, which can be fed both low-calorie combustion gas SG and high-calorie fuel 11, e.g. natural gas or fuel oil.

During operation of the premix burner 1 with low-calorie combustion gas SG, the combustion air 10 is swirled and the low-calorie combustion gas SG is injected into the swirling combustion air 10 and mixed with it. This mixture is then burned. Partially diluted low-calorie combustion gas SG can also be injected into the swirling combustion air 10 in this process. It is advantageous for the low-calorie combustion gas SG used to be a gasified fossil fuel, in particular gasified coal from a gasification facility. A synthesis gas operation can be implemented in a particularly advantageous manner in a gas turbine with the premix burner 1.

The essential advantage of the inventive premix burner 1 and the method described for burning a low-calorie fuel SG is that the proven premix combustion concept for natural gas and oil (high-calorie fuels) can be adopted without modification. This means that lengthy structural burner optimization operations and/or structural modifications are advantageously not required. The premix burner 1 is only extended to include an additional fuel passage for low-calorie combustion gases SG, without the structural conversion having a significant impact on the conventional operation of the combustion system with high-calorie fuels. The proposed structure allows particularly favorable mixing characteristics of the low-calorie combustion gas SG with the combustion air 10, allowing a sufficiently large throughput (flow volume) of synthesis gas SG to be supplied for the combustion process.

Figure 2:
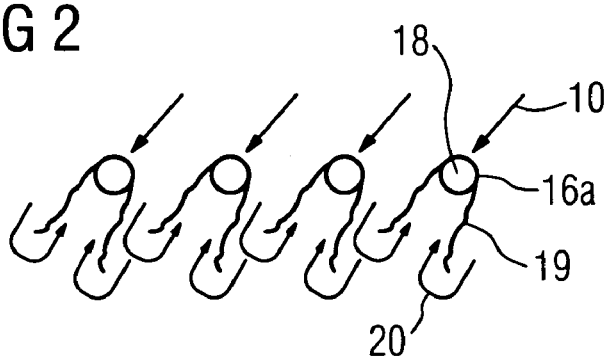
FIG. 2 shows a possible design for the inlet openings shown in FIG. 1

FIG. 2 shows a schematic top view of the inlet openings 16. FIG. 2 thereby shows in detail a possible structural design for the inlet openings 16 shown in FIG. 1. The inlet openings 16 in this exemplary embodiment have holes 16*a* with a circular cross-section 18 in the outer duct wall 15, which open into the premix air duct 2. The low-calorie combustion gas SG is injected into the premix air duct 2 and changes its direction there due to the powerful air mass flow 10 and is transported away by the air, with which it mixes intensively, to take part in the combustion process. The circular form of the cross-section 18 causes wake regions 19 to form downstream as the low-calorie combustion gas SG flows out of the holes 16*a*. The significant turbulence in the wake regions 19 causes backflow 20, running counter to the flow direction 21 of the combustion air 10, thereby increasing the risk of flashback significantly. There is therefore still scope to improve on the circular inlet openings 16*a*.

Figure 3:
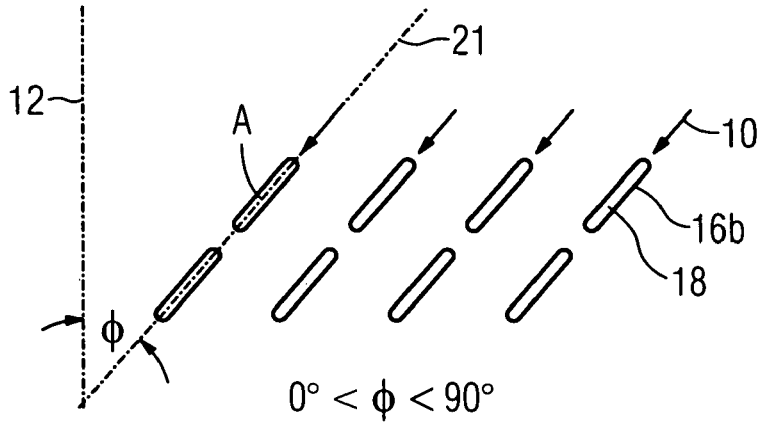
FIG. 3 shows a schematic top view of an improved embodiment of the inlet openings

FIG. 3 shows a schematic top view of an improved embodiment of the inlet openings 16. Instead of holes 16*a* with a circular cross-section 18, the inlet openings 16 are now configured as slots 16*b*. This structure prevents the development of wake regions 19 within the premix burner 1, at the same time allowing the low-calorie combustion gas SG to penetrate sufficiently deeply. The slots 16*b* have a longitudinal extension $L_1$ and a transverse extension $L_2$ (see discussion relating to FIG. 5 to FIG. 7). The longitudinal extension $L_1$ is generally around 3 to 10 times the transverse extension. In the diagram in FIG. 3 the longitudinal extension $L_1$ is roughly 6 times greater than the transverse extension $L_2$. The longitudinal extension $L_1$ defines a longitudinal axis A. This is parallel to the flow direction 21 of the combustion air 10. This means that the narrower side of the slot 16*b* is perpendicular to the flow direction 21 of the combustion air 10, thereby significantly reducing the resistance experienced by the combustion air 10 on contact with the combustion gas SG. As the flow direction 21 is at an angle $\phi$ to the burner axis 12 and the longitudinal axis A is parallel to the flow direction 21, the longitudinal axis A is now also at an angle $\phi$ to the burner axis 12.

Figure 4:
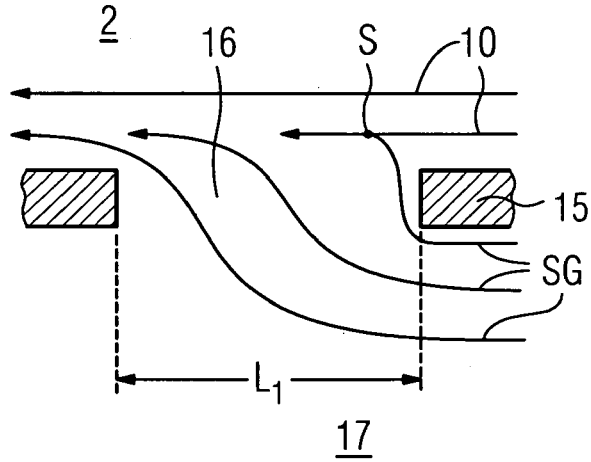
FIG. 4 shows a longitudinal section of an inlet opening shown in FIG. 3

FIG. 4 shows a schematic diagram of a longitudinal section of a slot-shaped inlet opening 16*b* shown in FIG. 3 along the longitudinal axis A. The inlet opening 16*b*, which has a longitudinal extension $L_1$, is incorporated in the outer duct wall 15. The low-calorie combustion gas SG is injected from the gas distributor ring 17, in this diagram the chamber below the inlet opening 16*b*, through the inlet opening 16 into the premix air duct 2. It meets the air mass flow 10 there and mixes with it. The point in the chamber, where the first contact takes place between the combustion gas SG and the combustion air 10 is also referred to as the stagnation point. In the arrangement shown, it is located upstream roughly at the end of the longitudinal extension $L_1$, just above the inlet opening 16. The gradual mixing of the combustion gas SG with the combustion air 10 starts from the stagnation point S and it continues downstream over the inlet opening 16*b* and possibly further.

Figure 5:
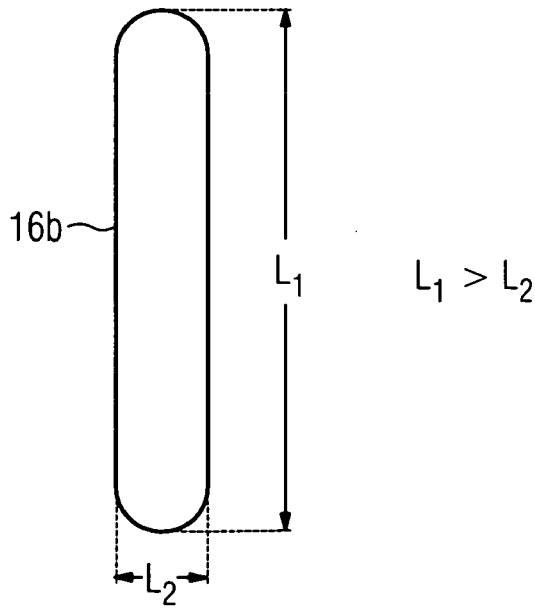
FIG. 5 shows a top view of a slot
Figure 6:
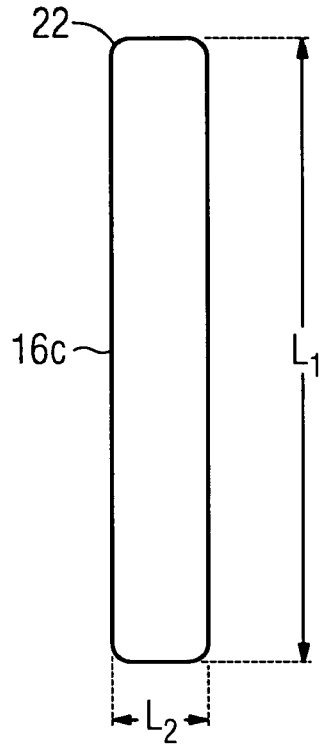
FIG. 6 shows a top view of a rectangle with rounded edges
Figure 7:
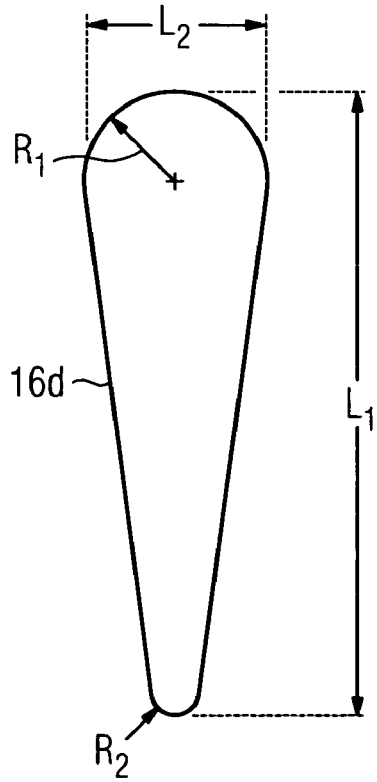
FIG. 7 shows a top view of a teardrop.

FIGS. 5, 6 and 7 show a schematic top view of three different embodiments of the inlet openings 16. The cross-section 18 in FIG. 5 shows a slot 16*b*, in FIG. 6 is shows a rectangle 16*c* with rounded corners 22 and in FIG. 7 it shows a teardrop 16*d*. All three embodiments have a longitudinal extension $L_1$ and a transverse extension $L_2$, it being generally the case that the longitudinal extension $L_1$ is greater than the transverse extension $L_2$. To prevent the formation of dead zones, in the case of the teardrop the acute angle is rounded. The teardrop then has two rounded areas with two rounding radii $R_1$ and $R_2$, where $R_1 > R_2$.

The injection device 13 for the low-calorie combustion gas SG can thus be tailored to the structural design, the number and arrangement of the inlet openings 16 of the respective deployment situation and requirements. This results in favorable geometric designs for the inlet openings 16 in each instance.

The invention claimed is:

1. A premix burner for burning a low-calorie combustion gas, comprising:

a pilot burner arranged coaxially with a burner axis;

a premix air duct defined by an inner duct wall and an outer duct wall arranged coaxially along the burner axis and encircling the pilot burner, and provides combustion air to the burner;

a helical device arranged in the premix air duct;

an injection device arranged downstream from the helical device that injects the low calorie combustion gas into the premix air duct, the injection device defining a plurality of combustion gas inlet openings, each inlet opening having:

a pair of longitudinal extension walls arranged essentially parallel to a longitudinal axis defined by a flow direction of the combustion air, and a pair of transverse extension walls arranged perpendicular to the longitudinal axis, wherein the longitudinal extension walls are greater in length than the transverse extension walls.

2. The premix burner as claimed in claim 1, wherein the pair of longitudinal extension walls form an acute angle and the pair of transverse extension walls are rounded.

3. The premix burner as claimed in claim 1, wherein the longitudinal extension walls are arranged parallel to a longitudinal axis defined by a flow direction of the combustion air.

4. The premix burner as claimed in claim 1, wherein the longitudinal extension is 3 to 10 times the transverse extension.

5. The premix burner as claimed in claim 4, wherein each inlet opening has a cross-section selected from the group consisting of: a slot, a rectangle with rounded corners and a teardrop.

6. The premix burner as claimed in claim 4, wherein the burner axis and the combustion air flow direction form an angle between 0° and 90°.

7. The premix burner as claimed in claim 6, wherein the injection device has a gas distribution ring that encloses the premix air duct.

8. The premix burner as claimed in claim 7, wherein the premix air duct is an annular duct having an outer or inner duct wall containing a plurality of inlet openings connected to the gas distribution ring.

9. The premix burner as claimed in claim 8, wherein the outer duct wall tapers in the direction of combustion air flow.

10. The premix burner as claimed in claim 9, wherein the outer duct wall is cone shaped.

11. A gas turbine engine, comprising:

an inlet manifold that inlets a air flow;

a compressor connected to the inlet manifold that receives the inlet air flow and compresses the air to provide a combustion air flow;

an annular combustion chamber that receives the combustion air flow and configured to combust a low-calorie fuel and provide a hot combustion flow, containing:

a pilot burner arranged coaxially with a burner axis;

a premix air duct defined by an inner duct wall and an outer duct wall arranged coaxially along the burner axis and encircling the pilot burner, and provides the combustion air flow to a premix burner;

a helical device arranged in the premix air duct;

an injection device arranged downstream from the helical device that injects the low-calorie combustion gas into the premix air duct, the injection device defining a plurality of combustion gas inlet openings, each inlet opening having:

a pair of longitudinal extension walls arranged essentially parallel to a longitudinal axis defined by a flow direction of the combustion air, and a pair of transverse extension walls arranged perpendicular to the longitudinal axis, wherein the longitudinal extension walls are greater in length than the transverse extension walls; and a turbine that receives and expands the hot combustion flow.

12. The gas turbine as claimed in claim 11, wherein the longitudinal extension is 3 to 10 times the transverse extension.

13. The gas turbine as claimed in claim 12, wherein each inlet opening has a cross-section selected from the group consisting of: a slot, a rectangle with rounded corners and a teardrop.

14. The gas turbine as claimed in claim 13, wherein the burner axis and the combustion air flow direction form an angle between 0° and 90°.

15. A method for burning a low-calorie combustion gas, comprising:

swirling a combustion air;

injecting the low-calorie combustion gas into the swirling combustion air through a plurality of elongated inlet openings which are disposed parallel to the flow direction of the combustion air;

mixing the low-calorie combustion gas and the swirling combustion air; and burning the low-calorie combustion gas and the combustion air mixture.

16. The method as claimed in claim 15, wherein the inlet opening shape inhibits the formation of wake regions and backflow and the inlet openings having a cross section and the cross-section having a longitudinal extension and a transverse extension wherein the longitudinal extension is greater than the transverse extension and the longitudinal extension is essentially parallel to the flow direction of the combustion air and the low-calorie combustion gas is injected.

17. The method as claimed in claim 16, wherein partially diluted combustion gas is injected into the swirling combustion air.

18. The method as claimed in claim 16, wherein the low-calorie combustion gas is a gasified fossil fuel.

19. The method as claimed in claim 18, wherein, the low-calorie combustion gas is a gasified coal.

20. The method as claimed in claim 15, wherein the low-calorie combustion gas and the combustion air mixture are burned in a gas turbine premix burner.

* * * * *